US008155571B2

(12) United States Patent
Van Dessel

(10) Patent No.: US 8,155,571 B2
(45) Date of Patent: Apr. 10, 2012

(54) PATTERNED DEVELOPING ROLLER

(75) Inventor: Bart Van Dessel, Zoersel (BE)

(73) Assignee: Xeikon Manufacturing N.V., Lier (BE)

( * ) Notice: Subject to any disclaimer, the term of this patent is extended or adjusted under 35 U.S.C. 154(b) by 470 days.

(21) Appl. No.: 12/149,045

(22) Filed: Apr. 25, 2008

(65) Prior Publication Data

US 2008/0279598 A1 Nov. 13, 2008

(30) Foreign Application Priority Data

Apr. 30, 2007 (EP) ..... 07447029

(51) Int. Cl.
*G03G 15/09* (2006.01)

(52) U.S. Cl. ..... 399/276

(58) Field of Classification Search ..... 399/276
See application file for complete search history.

(56) References Cited

U.S. PATENT DOCUMENTS

| | | | | | |
|---|---|---|---|---|---|
| 3,451,320 | A | * | 6/1969 | Sage | 399/363 |
| 4,018,187 | A | * | 4/1977 | Abbott et al. | 399/276 |
| 4,169,998 | A | | 10/1979 | Harada et al. | |
| 4,780,741 | A | * | 10/1988 | Wada et al. | 399/274 |
| 4,819,027 | A | | 4/1989 | Murasaki et al. | |
| 4,836,136 | A | * | 6/1989 | Natsuhara | 399/276 |
| 5,062,385 | A | | 11/1991 | Nishio et al. | |
| 5,153,376 | A | | 10/1992 | Tomita | |
| 5,502,552 | A | * | 3/1996 | Iwata et al. | 399/222 |
| 5,965,329 | A | * | 10/1999 | Sakaki et al. | 430/320 |
| 6,157,803 | A | | 12/2000 | Agatsuma | |
| 6,925,277 | B2 | * | 8/2005 | Sugihara | 399/276 |
| 7,103,305 | B2 | * | 9/2006 | Koike et al. | 399/274 |
| 2003/0170050 | A1 | * | 9/2003 | Terai | 399/267 |
| 2004/0037594 | A1 | | 2/2004 | Sakamaki et al. | |
| 2006/0045575 | A1 | | 3/2006 | Mabuchi et al. | |
| 2006/0204285 | A1 | * | 9/2006 | Zemba | 399/276 |
| 2007/0104516 | A1 | * | 5/2007 | Katoh et al. | 399/276 |
| 2007/0104517 | A1 | * | 5/2007 | Shimmura et al. | 399/276 |

FOREIGN PATENT DOCUMENTS

| | | | | |
|---|---|---|---|---|
| EP | 0 397 501 | A2 | 11/1990 | |
| EP | 1 225 257 | A2 | 7/2002 | |
| GB | 2 046 134 | A | 11/1980 | |
| JP | 60-142369 | | 7/1985 | |
| JP | 2003334820 | A * | 11/2003 | |
| JP | 2005-321628 | * | 11/2005 | 399/279 |

OTHER PUBLICATIONS

Document N translated in US 7,599,650.*
Search Report of European Patent Office Regarding EP 07447029.5 (Sep. 25, 2007) 7 pgs.
L.B. Schein, Electrophotography and Development Physics, 2nd Ed, 1988, pp. 36, 37, 158, 159.
Examination Report of European Patent Office regarding European Patent Application No. 07 447 029.5, Mar. 5, 2009.

* cited by examiner

*Primary Examiner* — David Gray
*Assistant Examiner* — David Bolduc
(74) *Attorney, Agent, or Firm* — Bacon & Thomas, PLLC

(57) ABSTRACT

A developing roller for providing a magnetic brush for a printer or copier has a substantially cylindrical outer surface. The outer surface includes a regular or irregular array of a number of isolated areas, each isolated area being provided by a recess in the outer surface. Each recess is completely surrounded on all sides and isolated from any neighbouring isolated area by separation zones being part of the substantially cylindrical outer surface.

38 Claims, 6 Drawing Sheets

601

602

603

PATTERNED DEVELOPING ROLLER

TECHNICAL FIELD OF THE INVENTION

The present invention relates to developing rollers for electrostatic printing or copying devices especially for creating magnetic brushes for use in electrostatic printing or copying devices as well as to marking devices such as printing or copying devices including the developer rollers and methods of making or operating the same.

BACKGROUND OF THE INVENTION

In electrostatic printing and/or copying machines, a latent image is first produced on a latent image carrying means such as e.g. photoconductive surface of a photosensitive drum. A developer can be made of toner particles only (single component developer) or a mixture of toner and magnetic carrier particles b (two component developer). A developer is spread onto the latent image from a developer unit. Different imaging modes can be used such as Charged Area Development (CAD) or Discharged Area Development (DAD) as explained in "Electrophotography and Development Physics" $2^{nd}$ edition 1988 by L. Schein (Springer Verlag) page 36. Using DAD, the toner is primarily attracted to those parts of the image which carry lower charge, typically as a result of imagewise discharge by an image exposure system, whereas the unexposed highly charged areas are not provided with toner. A toner image is so created on the latent image carrying means. The toner is manipulated in the developer by means of either its magnetic nature (single component magentic developer) or by means of the magnetic particles in the developer (two component developer) to place the toner into the correct state for printing or copying. Perfect control of the toner particles is required to prevent non-imagewise artifacts being generated in the image which are related to aspects of the developer and not the image. A medium on which the copy or the print is to be made, e.g. sheet of paper, plastic or cardboard, is then brought in juxtaposition with the toner image and receives a transfer of toner. The toner is then heated to bond the toner to the medium on which the finished copy or print is formed. Optionally, several toner images are made on several latent image carrying means, using toners of different colours, prior to transferring and binding the latent image to the finished copy or print by heating.

In one type of printer or copier, the toner is spread onto the latent image carrying means by using magnetic brushes. The magnetic brush is created on a developing roller which is part of the development unit that provides toner to the latent image carrying means. In this method of development, this occurs due to an electrostatic attraction between a charged toner and areas on the image carrying means, e.g. a photoreceptor. The development electrostatics can be adjusted so that development can take place in either the charged areas (CAD) or the discharged areas (DAD) of the image carrying means. Toner is added from a toner dispenser and it is mixed with magnetic particles called carrier particles. The toner is charged by triboelectricity and adheres to the carrier particles. A magnetic brush of developer particles is formed on a rotating sleeve surrounding magnets. The developer comprising the toner and magnetic carrier particles is attracted to the magnets and picked up by the sleeve. The magnetic carrier particles with attached toner form chains called a magnetic brush. The carrier is reused with new toner when toner is consumed in the image forming process.

In particular, in case of two component development systems using a developer comprising a mixture of (reusable) magnetic carrier particles and non-magnetic pigmented toner or toner particles for making a permanent image, these developing rollers comprise an internal magnet roller or discrete internal magnet configuration of permanent magnets or electromagnets and an outer sleeve, being the developing sleeve, which can rotate with or independently of the internal magnet configuration.

The permanent magnets typically may comprise rubber bond magnets or sintered rare earth magnets or combinations thereof.

Transport of toner is typically achieved by rotating the outer sleeve while the internal magnetic core remains static but alternative configurations exist where the internal magnet configuration is rotated in addition to a rotation of the sleeve.

The magnetic carrier particles, dressed with toner particles that are attached by electrostatic forces, form bead chains in interaction with the magnetic field as discussed for example in the Proceedings of the International Conference on Digital Printing Technologies, P. 742-747.

These bead chains create a magnetic brush on the sleeve. It is of importance to have a uniform magnetic brush with equally distributed bead chains over the sleeve surface.

The bead-chains of carrier particles dressed with toner, are magnetically attracted towards the outer sleeve surface of the developing roller by magnetic forces. The transport of the bead chains is believed to be the result of the magnetic interaction between the carrier particles and the magnet configuration, separated by the sleeve on one hand and the friction force between the sleeve surface and the carrier particles that contact the surface of the rotating developing sleeve on the other hand.

From U.S. Pat. No. 6,157,803 it is known that the surface condition or surface topology of the sleeve surface can influence the bead-chain build-up and development of the magnetic brush on the sleeve surface.

U.S. Pat. Nos. 4,018,187 and 5,153,376 teach to provide axially oriented grooves in the sleeve surface.

However there are some problems with the known rollers particularly when particular printing or copying conditions occur.

The provision of axially oriented grooves by presently known techniques causes the most demanding specifications of roundness and run-out for the sleeve to be met only with difficulty or even not to be met. This results in irregular distribution of toner particles in the final image.

In view of these issues there remains a need for cost-effective methods for making a developing sleeve having a good toner transfer characteristic, that can be used with durable materials such as non-magnetic steel and that also allow economic manufacture with the most demanding specifications of roundness and run-out for the sleeve as integrated in a developing roller for use in a printer or copier.

SUMMARY OF THE INVENTION

It is an object of the present invention to provide improved developing rollers, suitable for use in development units of electrostatic printers and copiers, and/or to provide printing or copying devices and/or methods of making or operating the same and/or to provide a method of printing. An advantage of the present invention is that it provides improved quality of copying or printing using toners comprising toner particles with high roundness and/or which reduces or avoids to a large extent artifacts such as striations when operated at a low speed ratio of magnetic brush, i.e. sleeve surface and latent image carrying means.

It is further an advantage of some embodiments of the present invention to provide a developing roller suitable for use of toners with toner particles having a high roundness at low speed ratio of magnetic brush, i.e. sleeve surface and latent image carrying means, providing a good print or copy quality and a long lifetime of developing rollers in general and developing sleeves in particular.

It is further an advantage of some embodiments of the present invention that the developing sleeve can be used for several 100,000 copies or prints with little or no degradation in the developer transport capability, i.e. the capability to create a magnetic brush on the surface of the developing sleeve.

The present invention also provides a sleeve for a developing roller having a surface with controlled topological features that is obtained with durable materials such as non-magnetic steel and that can meet demanding specifications of roundness and run-out for the sleeve as integrated in the developing roller. The present invention provides a sleeve for developing rollers with consistency of surface topology, i.e. only small or even no differences between topological features of sleeve surfaces of different developing rollers.

The present invention hence enables the combined use of toner particles with high roundness, i.e. with toner particles having a more spherical shape, and a development roller according to the present invention. The combination can be run at lower Vr/Vf ratio, with reduced or even no artifacts in the final image.

According to a first aspect of the present invention, a developing roller for providing a magnetic brush for a printer or copier is provided, the developing roller having a substantially cylindrical outer surface, at least part the said outer surface having been processed to include a regular or irregular array of a number of isolated areas, each isolated area being provided by a recess in the outer surface, each recess being completely surrounded on all sides and isolated from any neighbouring isolated area by separation zones, wherein the separation zones form part of the outer surface which is unprocessed such that they provide a substantially consistent surface topology at the substantially cylindrical outer surface of the roller.

Each recess may have a lateral dimension along the length of the roller, which lateral dimension is less than 10% or even less than 1% of the length of the roller.

A developing roller according to the first aspect of the present invention has the advantage that less or even no artifacts or traces such as striations are provided in the copied or printed image when compared to copying or printing using rollers with longitudinal grooves. This improvement is maintained even when copying or printing at low speed ratio, (i.e. the ratio of linear speed at the outer surface of the developing roller to the linear speed of the latent image bearing member or photosensitive drum at a transition point where the toner and possibly the carrier particles are transferred from the magnetic brush to the latent image bearing member). Further such good quality printing or copying can be achieved with toner particles having a high degree of roundness, i.e. an FPIA roundness of more than 0.95, such as in the range of 0.95 to 0.99; e.g. from 0.96 to 0.985, or in the range of 0.965 to 0.98.

The developing roller further comprises a set of magnets such as permanent or electromagnets. More particular, the outer sleeve may be provided rotatably relative to the internal magnetic core. The internal magnetic core may remain static or the internal magnet configuration is rotated in addition to a rotation of the sleeve.

According to some embodiments of the present invention, each isolated area has a perimeter at the outer surface, wherein for each isolated area the smallest imaginary circle encompassing the perimeter of this isolated area may have a diameter in the range of 200 to 750 μm.

Optionally for each isolated area the smallest imaginary circle encompassing the perimeter of this isolated area may have a diameter in the range of 250 μm to 580 μm.

According to some embodiments of the present invention, a magnetic brush seat is provided in each recess. A magnetic brush seat is a recessed flat portion substantially parallel with the outer surface. According to some embodiments of the present invention, the recesses may be bucket shaped. Bucket shaped may be described as a truncated tapered hollow shape, whereby the truncation forms the bottom and hollow shape widens towards the top which is open.

According to some embodiments of the present invention, each recess has a deepest point that may be at a depth of more than 30 μm from (below) the outer surface.

The depth is advantageously larger, preferably more than the average diameter of the carrier particles of the carrier. The particle size of the carrier particles is measured according to ASTM B 214. Standard ASTM B 214 is a standard test method for the sieve analysis of metal powders provided by ASTM International Standards Organisation—www.ASTM.org.

According to some embodiments of the present invention, the centre of the smallest imaginary circle encompassing the perimeter of each area defines an area centre point. The recesses comprise a wall. The average slope angle of the wall and the plane perpendicular to the radius of the area centre point may be more than 35°

For each point of the perimeter of the isolated area, an intersection line may be obtained by making the section of the recessed volume with a plane defined by this point and the radius of the area centre point. The inclination angle of the wall at this point of the perimeter is defined by the average of the angle between tangents of the intersection line and the radius of the area centre point, measured along the wall-part of this intersection line.

The slope angle of the wall at this point of the perimeter of the isolated area is 90° minus the inclination angle.

The average inclination angle is the average of the inclination angles measures along the perimeter of the isolated area.

The average slope angle is defined by 90° minus the average inclination angle.

The radius of the area centre point is the line defining the distance from the area centre point to the axis of the cylindrical outer surface, hence is the line connecting the area centre point and the cross section point of the axis with a plane being perpendicular to the axis and comprising the area centre point.

It has been found that the high average slope angles, thus the very steep walls, result in a more stable build up of the magnetic brush on the developing roller.

According to some embodiments of the present invention, the smallest distance between perimeters of two adjacent isolated areas may be more than or equal to 100 μm.

It has been found that such relatively large surface areas result in a stable build up of the magnetic brush on the developing roller. For some applications, the smallest distance between two adjacent isolated areas should preferably not be more than 500 μm.

According to some embodiments of the present invention, the perimeters of the isolated areas may have a circular, an oval or irregular or a polygonal shape.

The polygonal shape may be convex polygons and/or regular polygons. The polygons are preferably regular hexagons distributed over the surface according to a honeycomb pattern. Alternatively, the polygons can be diamond-shaped and regularly distributed over the surface. In another alternative, the isolated areas have circular shapes.

The surface area of recesses divided by the total surface area that is active for the developing roller and expressed as a percentage is preferably more than 30% optionally more than 35% even more preferred, more than 45%.

According to some embodiments of the present invention, the isolated areas may be distributed over the surface according to a regular pattern.

According to some embodiments of the present invention, the recesses may be obtained by tension-free processing The tension free processing is preferably photochemical milling. The sleeve of the developing roller is first provided with a desired surface condition.

The surface condition of the surface prior to chemical milling has an Ra of less than 0.1 μm.

The surface of the sleeve is substantially cylindrical, i.e. having a cylindrical runout of less than 50 micron, more preferentially less than 20 micron in the radial direction of the sleeve.

In case chemical milling is used, the outer surface of an unfinished roller or sleeve for a roller can be provided with a photoresist as well know to the skilled person. A photoresist is to be understood as a material sensitive to irradiation i.e. having changes in its chemical properties when irradiated; in the form of thin film used as a pattern transfer layer in lithographic processes. The resist may be a positive or a negative resist.

In one example, by appropriate illumination, the resist is developed at the surface zone being not the isolated areas. The non-developed resist is removed and the outer surface is etched using a chemical component or components suitable to remove sleeve material. This etching causes recesses to be provided at the isolated areas where no resist is present.

After etching, the developed resist is removed and a sleeve suitable for use in the developing roller according to the first aspect of the present invention is provided.

Tension free processing has the advantage that the roundness of the sleeve, hence of the developing roller is substantially not influenced or changed.

According to a second aspect of the present invention, a development unit for printing or copying markings on a medium is provided, which development unit comprising a developing roller according to the first aspect of the present invention.

According to a third aspect of the present invention, a printer or a copier is provided, which printer or copier comprises at least one developing roller according to the first aspect of the present invention or the development unit according to the second aspect of the present invention.

According to a fourth aspect of the present invention, a method of printing or copying markings on a medium is provided, the method comprising the steps of providing a developing roller for providing a magnetic brush according to the first aspect of the present invention; generating a magnetic brush by providing developer to the developing roller; using the magnetic brush to develop a latent image on a latent image bearing member, and forming an image on the surface of a medium using the developed image.

The developer comprises carrier particles having an average diameter. Each isolated area has a perimeter at the outer surface. According to some embodiments of the present invention, for each isolated area the smallest imaginary circle encompassing the perimeter of this isolated area has a diameter being 5 to 25 times the average diameter of the carrier particles, e.g. 5 to 20 times or 5 to 15 times.

The particle size of the carrier particles is measured according to ASTM B 214.

According to some embodiments of the present invention, each recess has a deepest point which deepest point may be at a depth of more than the average diameter of the carrier particles.

According to some embodiments of the present invention, the toner may comprise toner particles, which toner particles have an FPIA roundness of more than 0.95

The roundness of the toner particles can be measured using a flow particle image analyser of the type FPIA-2000 or FPIA-3000 manufactured by Sysmec corp.

According to some embodiments of the present invention, at least one developing roller is to transfer toner particles from its magnetic brush to a latent image bearing member at a transition point. At the transition point, the developing roller has a linear speed of Vr, the latent image bearing member has a linear speed in the same direction of Vf, Vr/Vf may be less than 1.6.

The present invention also includes a marked sheet medium having markings generated by any of the methods of the present invention or by use of a development unit according to the present invention.

Particular and preferred aspects of the invention are set out in the accompanying independent and dependent claims. Features from the dependent claims may be combined with features of the independent claims and with features of other dependent claims as appropriate and not merely as explicitly set out in the claims.

Although there has been constant improvement, change and evolution of devices in this field, the present concepts are believed to represent substantial new and novel improvements, including departures from prior practices, resulting in the provision of more efficient, stable and reliable devices of this nature.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DESCRIPTION OF ILLUSTRATIVE EMBODIMENTS

Figure 1:
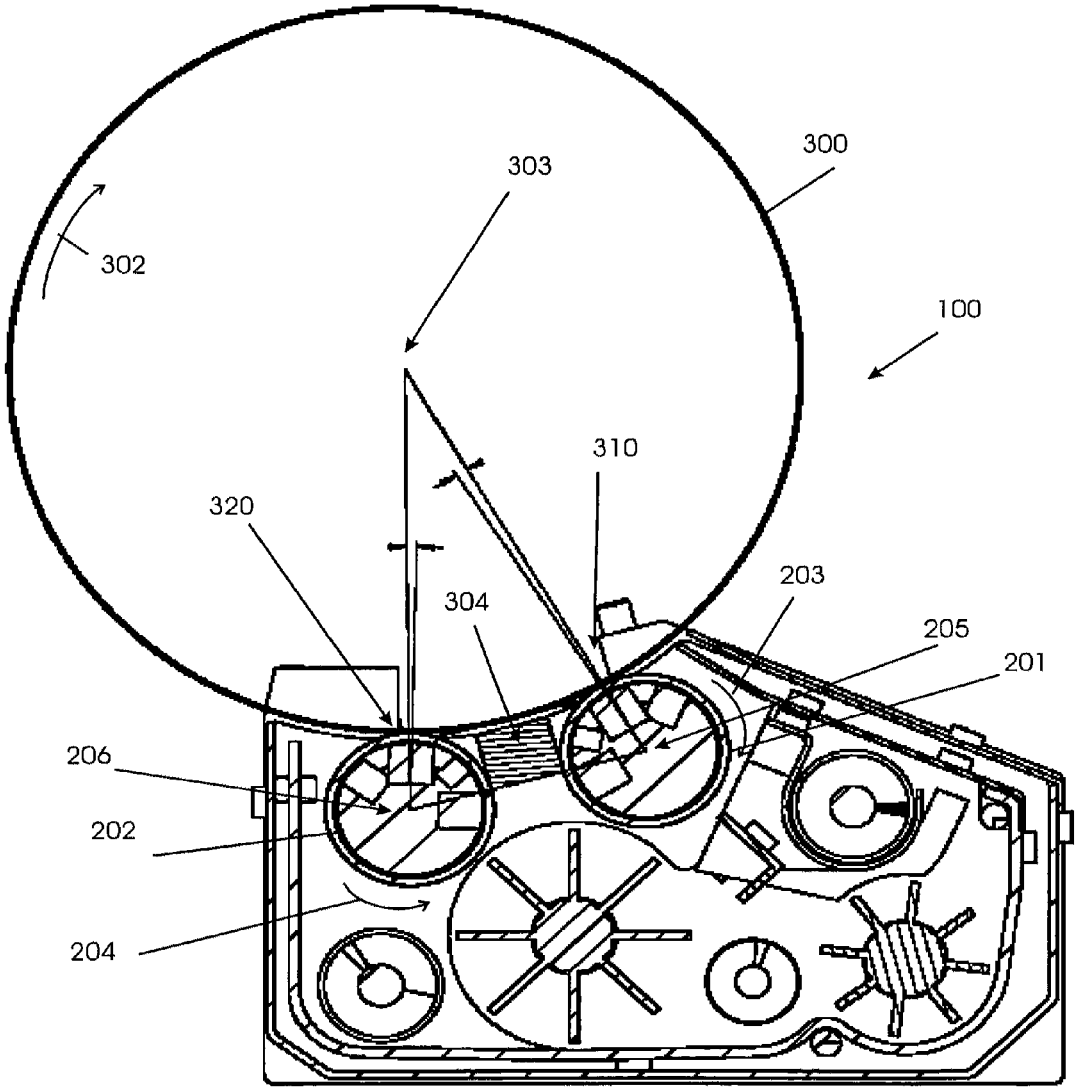
FIG. 1 is a schematic representation of a development unit according to an embodiment of the present invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "coupled", also used in the claims, should not be interpreted as being restricted to direct connections only. The terms "coupled" and "connected", along with their derivatives, may be used. It should be understood that these terms are not intended as synonyms for each other. Thus, the scope of the expression "a device A coupled to a device B" should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

The term "developer" as used in the present invention can be a single component or a multicomponent developer. Hence, the developer may include only toner particles. These toner particles can be magnetic if a magnetic brush is to be formed during the development process. The developer may also include two components, e.g. toner particles and carrier particles. The carrier particles can be magnetic if a magnetic brush is to be formed during the development process. Developers with more components than two are included within the scope of the present invention.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practised without these specific details. In other instances, well-known methods, structures and techniques have not been shown in detail in order not to obscure an understanding of this description.

The following terms are provided solely to aid in the understanding of the invention.

The term "FPIA roundness" or "circularity" of a particle can be measured using a Sysmex FPIA-2100 (Flow Particle Image Analyzer) as discussed in Asia Pacific Coatings Journal (2001), 14, (1), 21-23. The FPIA roundness or circularity of a particle is measured by:

- making a 2D-image of a particle by projecting the particle to a plane;
- defining the circular equivalent diameter, which is the diameter of an imaginary circle having a surface area identical to the surface area of the projection of the particle on the plane;
- defining the circularity of the particle image by dividing the circumference of the imaginary circle having a diameter equal to the circular equivalent diameter with the circumference of the particle measured on the particle image.

The "FPIA roundness" or "circularity" of toner particles is the average value of the "FPIA roundness" or "circularity" of a statistically representative number of particles of the toner.

The "isolated areas" or "islands" are to be understood as a plurality of isolated areas or zones having a first property, which are completely encompassed by a zone of the outer surface of the sleeve having a second property. The first and second properties are preferably topological properties. The first property is preferably the property of being a recess, whereas the second property is of being part of a cylindrical surface surrounding a recess.

The "smallest imaginary circle" is to be understood as the imaginary circle which encompasses the area and which has two points of contact with the perimeter of the area. The diameter of this circle is equal to the largest distance between two points on the perimeter of the area. The centre of this smallest imaginary circle is hereafter named area centre point.

Depth is the distance between the extension of the cylindrical surface if it were present at the isolated area, i.e. the envelope of the zones having the second property and the deepest point of the islands, e.g. recesses, which distance is measured along the radius of this deepest point.

Wall is the part of a recessed volume present between a depth of 0 to 80% of the maximum depth of the recess.

The bottom part is the part of the recessed volume present between a depth of 90 to 100% of the maximum depth of the recess.

The recessed volume may also comprise a transition zone between 80 and 90% of the maximum depth of the recess.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

The present invention is based in part on the realisation that the less the difference in speed between the latent image carrying means, such as e.g. photoconductive surface of a photosensitive drum or belt, and brush, such as a magnetic brush, i.e. the outer surface of the developing sleeve provided with bead-chains of carrier and toner particles, the more important the surface topologies of the developing sleeve becomes. Line patterns or "striations" matching with the axial grooves may more easily be noticed when rounded or oval shaped toner particles is used. Toner particles having a high roundness, combined with a low speed ratio of magnetic brush, i.e. sleeve surface and latent image carrying means, results in non-imagewise artifacts such as lines visible in the printed image. Irregular distribution of toner particles in the final image occurs more often when toner particles with high roundness are used. Round toner is assumed to have a higher mobility for rearrangement on the carrier surface to which it electrostatically adheres, presumably by the possibility of rolling displacement. As a result, toner can more effectively move away from between the carrier beads that form the magnetic bristle "hairs". Defects in the development rollers, such as a too large run-out may result in artifacts which are more pronounced in case toner particles with higher roundness are used.

Similarly, in case a small ratio "Vr/Vf", i.e. the ratio of rotation speed of development sleeve of a development roller and the image carrying means, is used, artifacts due to e.g. run-out of the developing sleeve become more visible. This is due to the lower transfer of toner particles between developing sleeve and image carrying means at such lower ratios. This is explained in "Electrophotography and Development Physics" $2^{nd}$ edition 1988 by L. Schein (Springer Verlag) page 158.

As less toner particles tend to transfer from developing sleeve to image carrying means in the transition point or "nip", other parameters have a more pronounced influence on the amount of toner particles being transferred. As an example, a higher run-out of the sleeve influences the transfer of particles more, hence create more pronounced artifacts, when a low speed ratio Vr/Vf is used.

Such artifacts are even more noticeable when a high roundness of the toner particle is combined with a low Vr/Vf ratio.

The present invention provides a suitable solution for the use of toners with toner particles having a high roundness at low speed ratio of magnetic brush, i.e. sleeve surface and latent image carrying means, while providing a good print quality and a long lifetime of developing rollers in general and developing sleeves in particular.

FIG. 1 shows schematically a development unit 100 in accordance with one embodiment of the present invention. The development unit 100 comprises a first developing roller 201 and a second developing roller 202. The developer unit can have some or all of the following functions:

- Charge the toner (e.g. through toner/carrier, toner/metering blade friction).
- Move the toner to the electrostatic development zone.
- Establish the necessary electrostatic forces on the toner particles to cause them to move onto the latent image.
- Remove unused toner.

In one embodiment of the present invention a developing roller for providing a magnetic brush comprises a developing sleeve. This sleeve provides the outer surface of the developing roller. The developing sleeve has a substantially cylindrical outer surface, the sleeve comprising a number of isolated areas at its outer surface, each isolated area being provided by a recess in the outer surface. The sleeve is intended to rotate relative to an internal magnet configuration. Each isolated area is completely surrounded by a separation zone. The separation zone comprises a part of the outer cylindrical surface of the sleeve or roller. In an operational configuration the development unit 100 is provided in a fixed positional relation to the latent image bearing member 300, e.g. a drum or a belt. The first and second developing rollers 201 and 202 are provided to transfer toner particles from the magnetic brush to the latent image bearing member 300 at a transition points 310 and 320. As indicated with arrow 302, the latent image bearing member 300 rotates in a clockwise direction about an axis 303.

For the embodiment as shown in FIG. 1, and as indicated with arrow 203, the first developing roller 201 rotates clockwise about an axis 205. The second developing roller 202 rotates counter clockwise about an axis 206, as indicated by arrow 204. At least one of the rollers, such as the last roller rotates in a counter-clockwise direction. For this particular setup, the sequence "first", "second" and "last" is to be understood as the sequence in which the rollers are facing a given point travelling with the image carrying member that is rotating, in this particular case rotating clockwise. In alternative embodiments of the current invention, the first roller can be chosen to rotate in the counter-clockwise as well.

At the transition point 310, the first developing roller 201 has a linear speed of Vr1 and the latent image bearing member 300 has a linear speed of Vf1. Vr1 and Vf1 are in opposed directions. At the transition point 320, the second developing roller 202 has a linear speed of Vr2 and the latent image bearing member 300 has a linear speed of Vf2. Vr2 and Vf2 are in the same direction. The magnitude of Vf1 and Vf2 can be the same.

Figure 2:
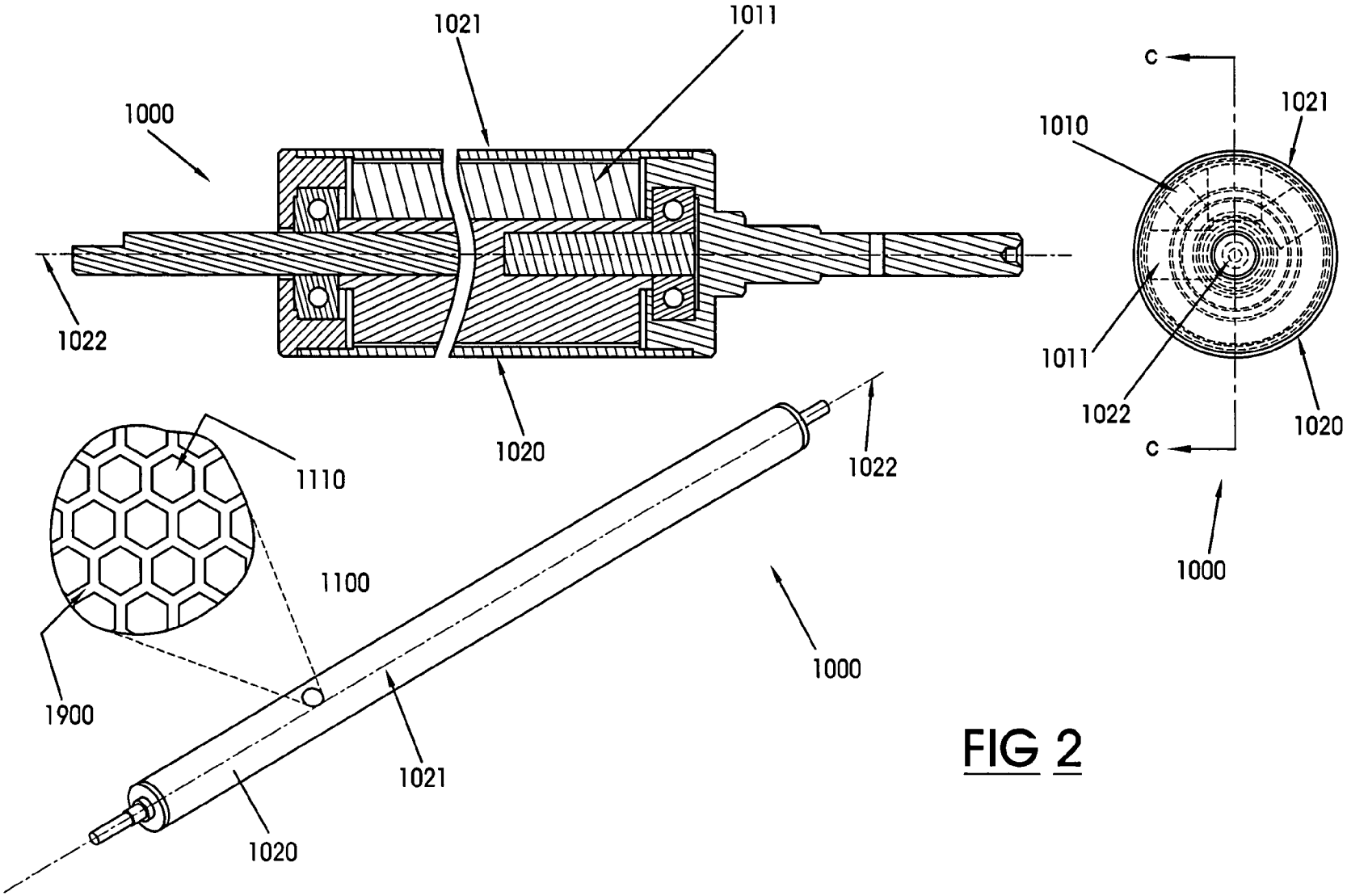
FIG. 2 is a schematic representation of a development roller according to an embodiment of the present invention.

Turning now to the developing roller 1000 as shown in FIG. 2, which is representative for the developing rollers 201 and 202 of FIG. 1, the developing roller comprises a discrete internal magnet configuration 1010 comprising a number of permanent magnets 1011, i.e. one or more. In an alternative embodiment, electromagnets may be used instead of or in combination with the permanent magnets. The developing roller 1000 further comprises a developing sleeve 1020 having a substantially cylindrical outer surface 1021. The developing sleeve 1020 is rotatable about an axis 1022. The sleeve comprises a number of isolated areas 1100 at its outer surface 1021, each isolated area being provided by a recess 1110 in the outer surface 1021. Each isolated area 1100 is completely, i.e. on all sides, surrounded by separation zones 1900, which isolate each isolated area from any neighbouring isolated area.

Figure 3A:
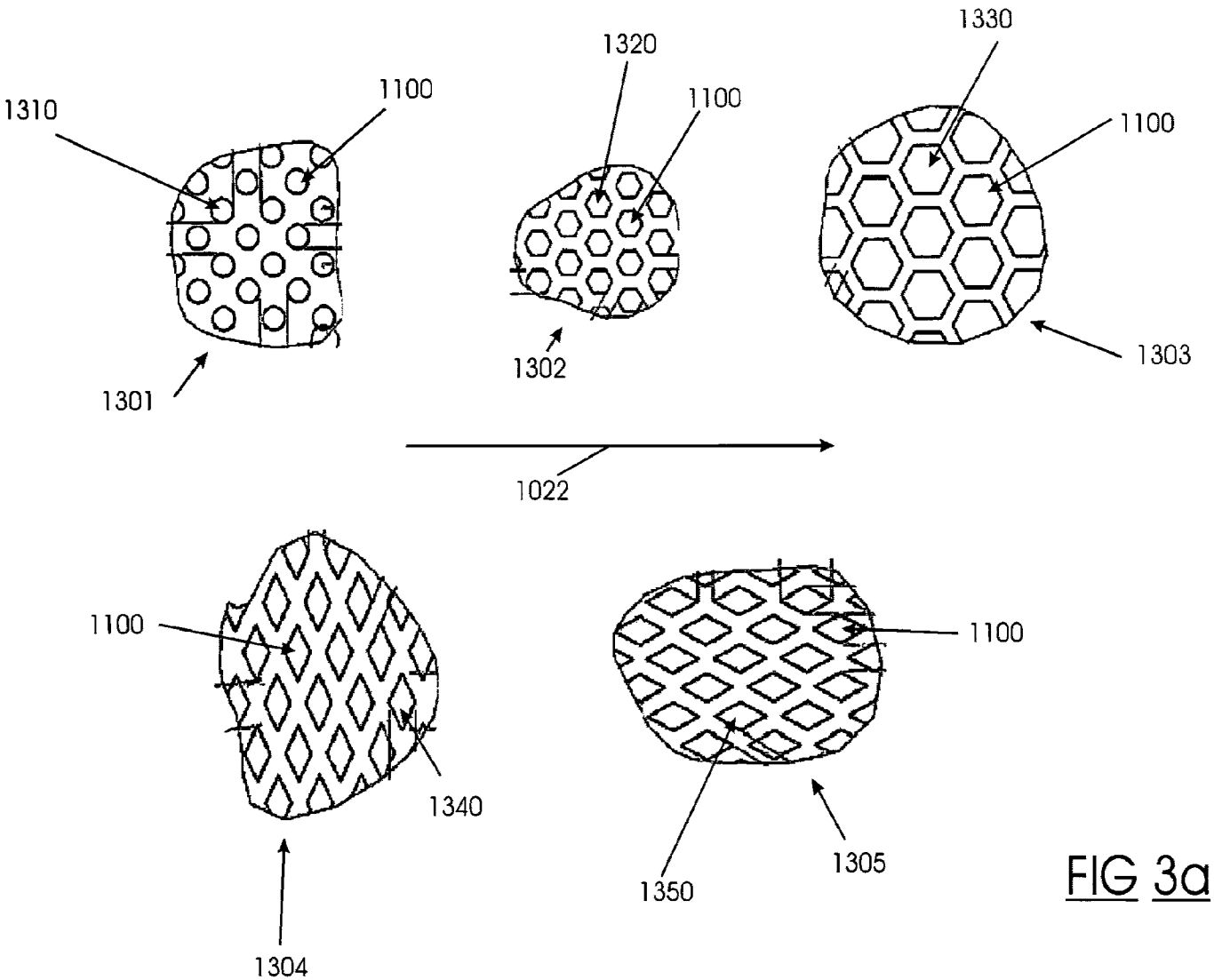
FIG. 3*a* and FIG. 3*b* show arrangements of isolated areas or "islands" on the outer surface of a developing sleeve of a development roller according to an embodiment of the present invention.
Figure 3B:
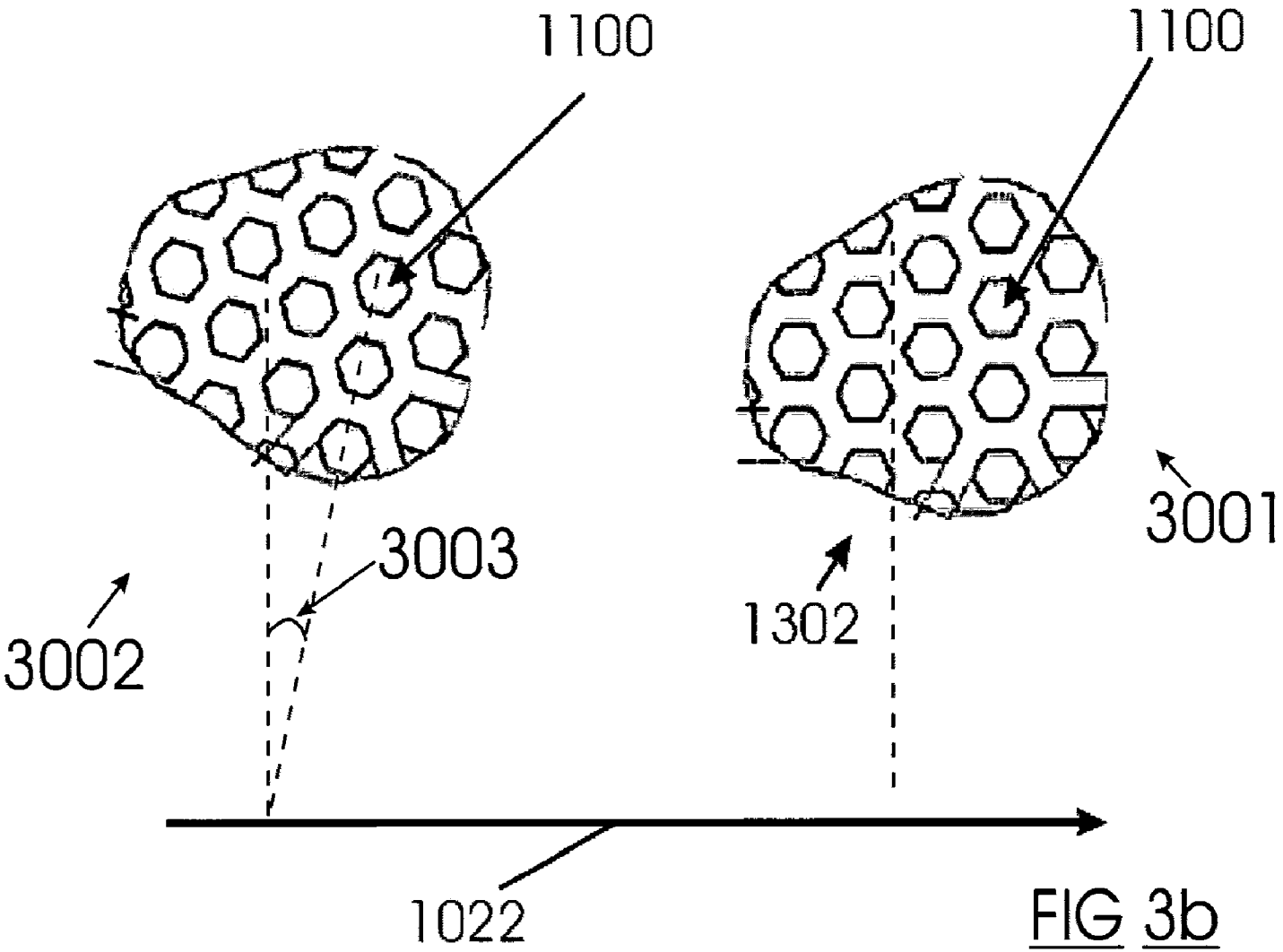

Optional alternative arrangements of isolated areas 1100 or "islands" on the outer surface 1021 are shown in FIG. 3*a* and FIG. 3*b*. The deployment along a line parallel to the axis 1022 to a plane of some possible outer surfaces 1301 to 1305 of the cylinders outer surface are shown.

As shown in FIG. 3*a*, in the outer surface of the sleeve, a number of islands are uniformly distributed over the outer surface of the sleeve. The distribution may be regular or it may be irregular, e.g. having a random pattern. Where a regular pattern is provided these may be in any suitable regular pattern such as known from crystallographic studies, e.g. close packed. The outer shape of the recesses between islands of the sleeve outer surface may be any suitable shape such as polygonal, e.g. hexagonal, circular, oval or irregular in shape. In the outer surface 1301 of the sleeve as an example, a number of circular islands are uniformly distributed over the outer surface 1301. As an example, the circular shapes can have a diameter of 0.25 mm. The edge-to-edge distance between adjacent areas 1310 in a direction parallel to axis 1022 is 0.32 mm. The edge-to-edge distance between adjacent areas 1310 in a direction perpendicular to axis 1022 is also 0.32 mm. Each area 1310 has eight adjacent areas, two on an edge-to-edge distance 0.32 mm in the direction of the axis 1022, two on an edge-to-edge distance 0.32 mm in the direction perpendicular to the axis 1022. Each area has further four adjacent areas located with a centre-to-centre line making an angle of 45° with the axis 1022 and being on an edge-to-edge distance of 0.153 mm. Thus between two adjacent areas, the distance is at least more than 100 μm, more particular in this case about 153 μm. For each isolated area 1310, the smallest imaginary circle encompassing the perimeter of this isolated area is identical to the circular shape of the area itself and has a diameter of 250 μm. The centre of the smallest imaginary circle is identical to the centre of the circular shape itself. The surface area of the isolated areas 1310 in percentage of the total surface area of the sleeve is 30% (i.e. with respect to the active area of the sleeve that is to be involved in the developing process).

In an alternative the outer surface 1302 has a number of hexagonally shaped islands 1320 regularly or irregularly distributed, e.g. uniformly distributed over the outer surface 1302. For each isolated area 1320, the smallest imaginary circle encompassing the perimeter of this isolated area is the distance between two facing angles of the hexagonal. In this particular embodiment, the diameter of the smallest encompassing circle is 0.29 mm. The centre of the smallest encompassing circle is identical to the cross point of the diagonals of the hexagonal shape.

The hexagon shapes are uniformly distributed over the surface 1302 according to a honeycomb structure. The edge-to-edge distance between adjacent areas 1320 in a direction perpendicular to each of the sides of the hexagonal shapes is 0.15 mm. As an example, the surface area of the isolated areas 1320 in percentage of the total surface area of the sleeve is 37%.

In outer surface 1303, a similar pattern of areas 1330 is provided as for surface 1302. A number of hexagonally shaped islands 1330 are uniformly distributed over the outer surface 1303. For each isolated area 1330, the smallest imaginary circle encompassing the perimeter of this isolated area is the distance between two facing angles of the hexagonal. In this particular embodiment, the diameter of the smallest encompassing circle is 0.570 mm. The centre of the smallest encompassing circle is identical to the cross point of the diagonals of the hexagonal shape.

The hexagon shapes are uniformly distributed over the surface 1303 according to a honeycomb structure. The edge-to-edge distance between adjacent areas 1330 in a direction perpendicular to each of the sides of the hexagonal shapes is 0.15 mm. The surface area of the isolated areas 1330 in percentage of the total surface area of the sleeve is 57%.

In outer surface 1304, a number of areas 1340 are distributed over the surface 1304 identically as for surface 1301. The plurality of diamond shaped islands 1340 is uniformly distributed over the outer surface 1304. For each isolated area 1340, the smallest imaginary circle encompassing the perimeter of this isolated area is the length of the largest diagonal of the diamond shape. In this particular embodiment, the diameter of the smallest encompassing circle is 0.5 mm. The length of the smallest diagonal is 0.25 mm. The centre of the smallest encompassing circle is identical to the cross point of the diagonals of the diamond shape.

The edge-to-edge distance between adjacent areas 1340 is 0.15 mm. the diamond shapes are oriented with their smallest diagonal parallel to the axis 1022.

In outer surface 1305, the areas 1350 are identical to the areas 1340 of surface 1304. The only difference between subsurface 1340 and 1350 is the orientation of the diamond shapes of the areas. In surface 1350, the largest diagonal of the diamond shapes are oriented parallel to the axis 1022.

The surface area of the isolated areas 1340 in percentage of the total surface area of the sleeve is 42%. The surface area of the isolated areas 1350 in percentage of the total surface area of the sleeve is also 42%.

As best shown in FIG. 3*b*, as the sleeve rotates around the axis 1022, the isolated areas 1100 of surface 1302 are aligned in columns relative to the axis 1022, as shown and indicated in configuration 3001 in FIG. 3*b*. It was found advantageous to rotate the orientation of the isolated areas 1100 of the surface 1302 over an angle 3003 relative to the axis 1022, thereby providing a structure pattern 3002. This rotation, which may be obtained by using even only a small angle 3003, causes the bristle hairs of the magnetic brush, which hairs finds base in, and are aligned with, the recesses, not to be aligned in columns and rows relative to the axis of rotation. Such alignment in columns and rows relative to the axis 1022 could cause uneven wear of wear sensitive components such as the edges of trimming bar 304 in FIG. 1.

Figure 4:
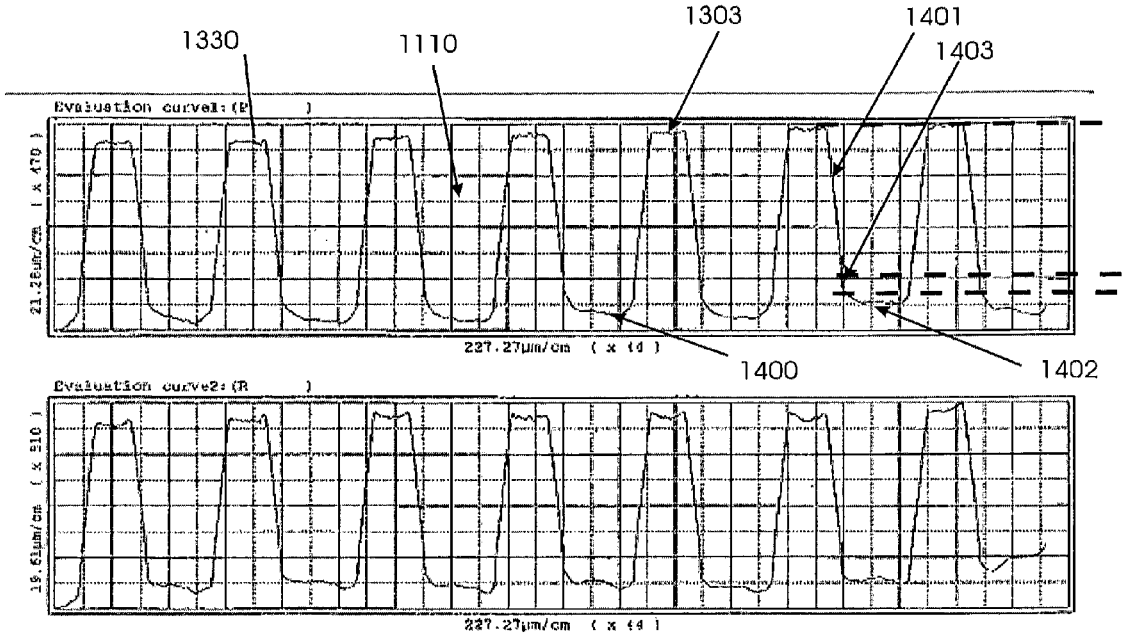
FIG. 4 shows recesses having a bucket shape and providing the isolated areas in the developing sleeve of a developing roller according to an embodiment of the present invention.
Figure 4:
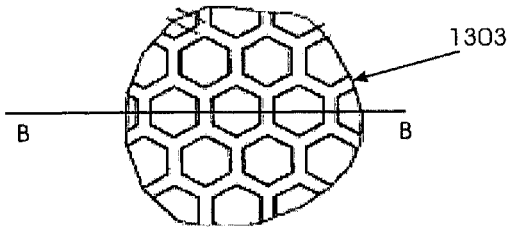

An example of the recesses each having a magnetic brush seat and providing the isolated areas in the developing sleeve of a developing roller as subject of the present invention is best shown in FIG. 4. A magnetic brush seat is a surface that is suitable to form the base for a magnetic brush strand. The magnetic brush seat is preferably a recessed flat area substantially parallel with the outer surface. The magnetic brush seat can be bucket shaped. Bucket shaped may be described as a truncated tapered hollow shape, whereby the truncation forms the bottom and the tapered shape widens towards the top which is open. FIG. 4 shows a cross section profile of a developing sleeve having a surface according to the sleeve surface 1303 of FIG. 3. The cross section is obtained by a cross section according to the plane BB, which is the plane perpendicular to the axis 1022.

It is understood that the recesses providing the isolated areas of the other surfaces shown in FIG. 3*a* and FIG. 3*b* are similar if not identical.

The recesses 1110 in the outer surface 1303 provide the isolated areas 1330.

Each recess 1110 has a deepest point 1400 being at a depth of more than 30 μm from the outer surface. In the present case the depth is 0.07 mm. The sleeve is cylindrical to a high level of tolerance. The difference in depths of the recesses measured with respect to the outer surface 1303 over the whole active area of the sleeve is less than 20 micron, e.g. 15 micron or less, preferably 10 micron or even less than 5 μm or less.

Each recess 1110 comprises a wall 1401, a bottom part 1402 and a transition zone 1403. The bottom part 1402 forms a magnetic brush seat. The average slope angle of the wall and the plane perpendicular to the radius of the area centre point is more than 35°. The recess may be described as "bucket shaped", i.e. relatively steep sides and a relatively flat bottom. Bucket shaped may be described as a truncated tapered hollow shape, whereby the truncation forms the bottom and the hollow shape widens towards the top which is open. The truncated tapered shape or bucket shape does not need to be circular in cross-section but could be circular, polygonal, oval or irregular in shape.

Figure 5:
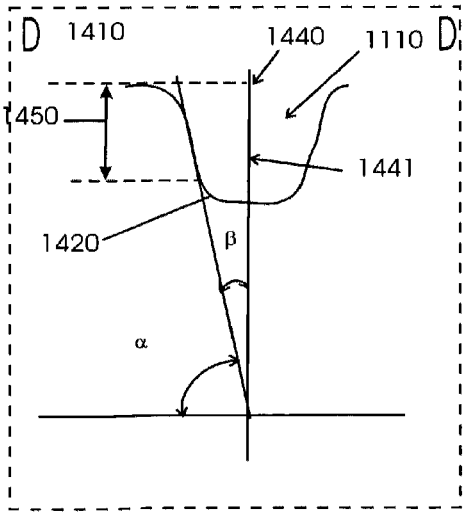
FIG. 5 is a schematic representation of a recesses in the developing sleeve of a developing roller according to an embodiment of the present invention.
Figure 5:
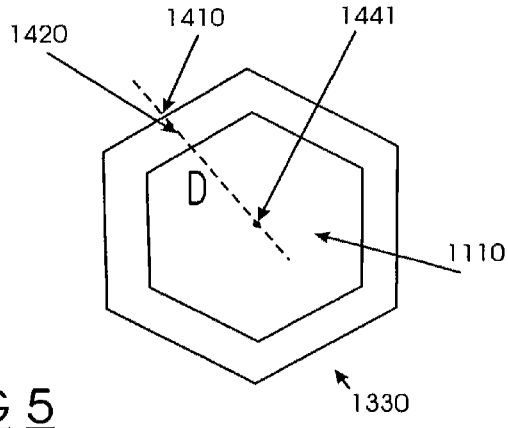

This average slope angle of the wall is calculated as follows, and is illustrated using FIG. 5.

For each point 1410 of the perimeter 1411 of the isolated area 1330, a intersection line 1420 is obtained by make the section of the recessed volume of the recess 1110 with a plane DD defined by this point 1410 and the radius 1441 of the area centre point 1440. The inclination angle β of the wall at this point of the perimeter is defined by the average of the angle between tangents of the intersection line 1420 and the radius of the area centre point, measured along the wall-part 1450 of this intersection line 1420.

The slope angle α of the wall at this point of the perimeter of the isolated area is 90° minus the inclination angle α.

The average inclination angle is the average of the inclination angles β measured along the complete perimeter 1411 of the isolated area, i.e. making the average along the perimeter 1411.

The average slope angle is defined by 90° minus the average inclination angle. In this particular embodiment, the average slope is 45°.

The developing sleeve of the developing roller for providing a magnetic brush was provided from high precision steel, type stainless steel 304.

The developing sleeve was further provided with a magnet configuration consisting of discrete rubber bonded magnets 1011 on shaft 1022 as depicted in FIG. 2, which magnet configuration is inserted in the hollow volume of the cylindrical sleeve. The magnetic flux density measured on the sleeve in the direction normal to the sleeve is typically in the range from 50 to 100 mT right above the discrete magnets 1011.

An alternative method for producing the internal magnet configuration consists of magnetizing a cylindrical volume of sintered or rubber bonded ferrite attached to or surrounding the shaft 1022 in a specifically build magnetizing yoke as described in U.S. Pat. No. 4,169,998.

The surface of the sleeve is substantially cylindrical, i.e. having a runout of better than 50 micron, more preferentially better than 20 micron in the radial dimension.

Suitable methods of creating the recesses in the sleeve are those which impose low mechanical forces on the sleeve. Mechanical forces can result in distortion of the sleeve from its cylindrical shape. Accordingly, tension- or stress-free methods of forming the recesses are preferred.

Examples of suitable manufacturing methods are chemical milling, laser ablation, etching, electro-spark discharge machining, high energy beam erosion or milling. Although a tension- or stress-free method, sand blasting is not preferred as it does not provide "bucket-shaped" recesses but instead rather rounded and shallow depressions. Although point-wise mechanical milling is not a tension- or stress-free machining method it can be used to generate the recesses provided precautions are taken to support the sleeve in such a way so that mechanical distortions are reduced to a minimum. Particularly preferred is chemical milling for providing the recesses in the developing sleeves 1000.

One method of forming the recesses in accordance with an embodiment of the present invention includes the following steps. First the outer surface, at that moment without recesses, is provided with a photoresist layer. This photoresist layer is processed by microlithography as is known to the skilled person of semiconductor processing. Either positive or negative resists can be used, the process then needing to be adapted to which one is used.

The resist layer is illuminated with the desired pattern and then the resist is developed, thereby providing an image of developed resist identical to the patterns also referred to as "masks", as shown in FIG. 3. The resist was not developed at the areas indicated 1310, 1320, 1330, 1340 or 1350 in the FIG. 3. The non-developed resist is removed and the outer surface is etched using a chemical component or components suitable to remove sleeve material. This etching causes the recesses to be provided at the isolated areas where no resist is present. The size of the apertures in the resist layer through which etching liquids will obtain access to the underlying material has to be dimensioned taking into account of the etching materials used. An isotropic etching fluid will not only etch into the underlying material is will also tend to etch laterally.

After etching, the developed resist is removed and additional steps may be performed, e.g. cleaning and polishing to thereby provide a sleeve suitable for use in the developing roller according to the first aspect of the present invention. Using this method, a developing sleeve with recesses as shown in FIG. 4 was obtained.

This tension free processing has the advantage that the roundness of the sleeve, hence of the developing roller is substantially not influenced or changed.

Other arrangements for accomplishing the objectives of the developing roller embodying the invention will be obvious for those skilled in the art.

The developing rollers according to this first aspect of the present invention allow the provision of developing units, hence of printing or copying apparatuses such as electrostatic printers of copiers, which are able to print at low speed ratio using toners with high roundness of the toner particles.

According to a second aspect of the present invention, a method of printing is provided, comprising the step of providing a developing roller for providing a magnetic brush. This developing roller comprises a developing sleeve having a substantially cylindrical outer surface, the sleeve comprising a number of isolated areas at its outer surface. Each isolated area is provided by a recess in the outer surface. Optionally, the developing roller is provided and has the features as set out above according to the first aspect of the present invention.

In a next step, a magnetic brush is provided by providing toner to the developing roller. This toner may be a two component toner comprising toner particles and carrier particles.

Preferably the isolated areas have a perimeter at the outer surface for which the smallest imaginary circle encompassing the perimeter has a diameter being 5 to 15 times the average diameter of the carrier particles. Preferably the depth of the recesses is more than the average diameter of the carrier particle.

The method further comprises the step of using the magnetic brush to provide a printed surface on a medium, such as paper or cardboard. The toner may comprise toner particles having an FPIA roundness of more than 0.95.

In a preferred method, the developing roller is to transfer toner particles from its magnetic brush to a latent image bearing member at a transition point.

At the transition point, the developing roller has a linear speed of Vr, the latent image bearing member has a linear speed of Vf. Preferably the speed ratio Vr/Vf is less than 1.6.

Several tests were done to demonstrate the effect of the speed ratio and toner particle roundness on the point quality.

Figure 6:
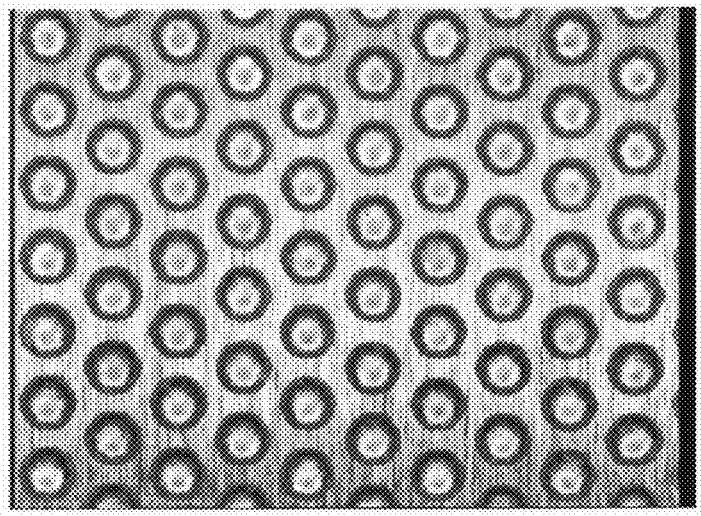
FIG. 6 presents views of sleeve surfaces of developing sleeves of development rollers according to an embodiment of the present invention In the different figures, the same reference signs refer to the same or analogous elements.
Figure 6:
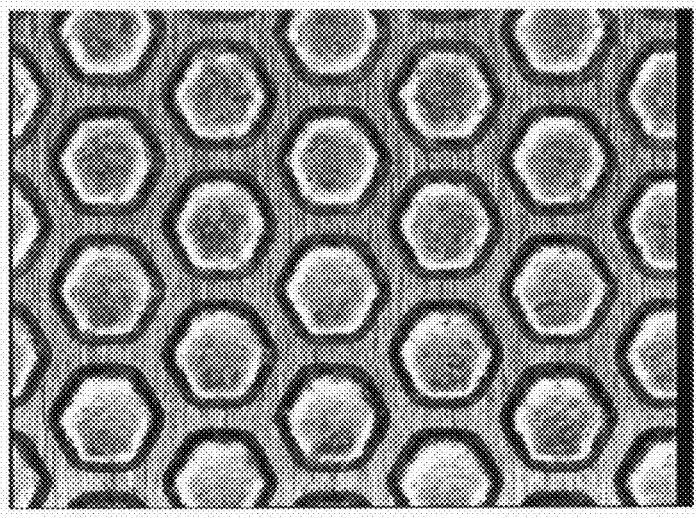
Figure 6:
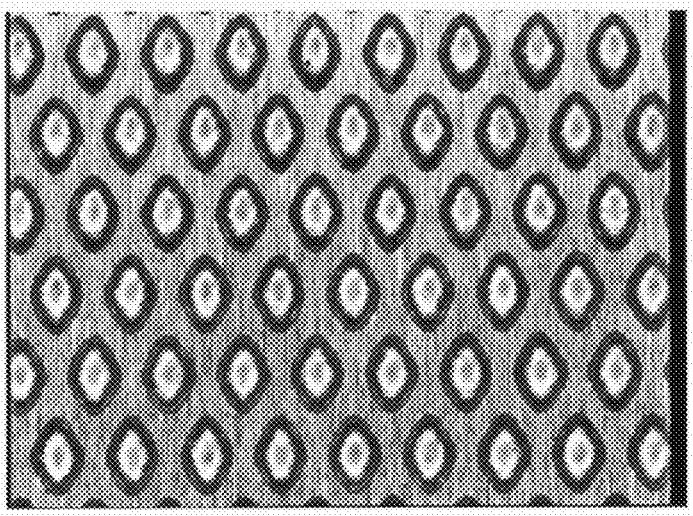

Three sleeve surfaces were tested. The sleeve surfaces are shown in FIG. 6. Sleeve surface 601 is identical to the sleeve surface 1310 of FIG. 3. Sleeve surface 602 is identical to the sleeve surface 1330 of FIG. 3. Sleeve surface 603 is identical to the sleeve surface 1340 of FIG. 3. Developing rollers with such developing sleeves were used in combination with different toners having different roundness and in combination with different speed ratios. A comparison was made with developing rollers being provided with axially oriented grooves having similar dimensions. An appreciation of the presence of striations is given, where 1 indicates no striations noticeable, 2 indicates minor indication of striations, and 3 indicates clearly visible striations.

Though the sleeve surface 1303 was preferred, the three sleeve surfaces did not show any particular significant difference in behaviour.

The test was done using a dual roller system such as known from FIG. 6 of US2006/0045575, where the first developing roller has a linear displacement in opposite direction of the latent image bearing member at the transition point of the first development roller and the image carrying member. The speed ratio of development roller over image carrying member, i.e. Vr/Vf was chosen 0.8 for all tests whose results are shown in table 1. At the transition point of the second development roller and the image carrying member, the second developing roller has a linear displacement in the same direction as the latent image bearing member, and its Vr/Vf ratio was varied between 2.8 and 1, as indicated in table 1.

TABLE 1

| Type of developing sleeve | Axially groove sleeve | | sleeve with surface according to 1310, 1330 or 1340 | |
|---|---|---|---|---|
| | Toner roundness | | | |
| | 0.95 | 0.97 | 0.95 | 0.97 |
| Vr/Vf 2.8 | 1 | 1 | 1 | 1 |
| Vr/Vf 2.2 | 1 | 1 | 1 | 1 |
| Vr/Vf 1.8 | 1 | 2 | 1 | 1 |
| Vr/Vf 1.5 | 2 | 3 | 1 | 1 |
| Vr/Vf 1.3 | 3 | 3 | 1 | 1 |
| Vr/Vf 1.0 | 3 | 3 | 1 | 1 |

It is clear that the provision of developing rollers according to the first aspect of the present invention allow an improvement in the printing or copying quality under certain desirable printing or copying circumstances using toners with high roundness of toner particles. After several 100,000 copies or prints, the quality of the transfer of toner particles to the latent image carrying means did not change significantly It is to be understood that although preferred embodiments, specific constructions and configurations, as well as materials, have been discussed herein for devices according to the present invention, various changes or modifications in form and detail may be made without departing from the scope and spirit of this invention.

Steps may be added or deleted to methods described within the scope of the present invention.

The invention claimed is:

1. A developing roller for providing a magnetic brush for an electrostatic printer or copier, said developing roller comprising:

a non-magnetic steel sleeve with a substantially cylindrical outer surface having processed areas with material removed and unprocessed areas without material removed, at least part of said processed areas with material removed of said substantially cylindrical outer surface including a regular or irregular array of a number of neighbouring isolated areas, each said isolated area having a recess in said substantially cylindrical outer surface, each said recess completely surrounded on all sides and isolated from neighbouring isolated areas by separation zones, wherein said separation zones form part of said unprocessed areas without material removed of said substantially cylindrical outer surface such that said separation zones provide a substantially consistent surface topology at the substantially cylindrical outer surface of said developing roller, wherein both the surface of processed areas with material removed and the surface of unprocessed areas without material removed is non-magnetic steel.

2. A developing roller according to claim 1, wherein each said isolated area has an encompassing perimeter lying on said substantially cylindrical outer surface of said developing roller, and each said encompassing perimeter has a diameter in the range of 200 to 750 μm.

3. A developing roller according to claim 1, wherein each of said recesses provides a magnetic brush seat.

4. A developing roller according to claim 1, wherein said recesses are bucket shaped.

5. A developing roller according to claim 1, wherein each said recess has a deepest point having a depth of more than 30 μm from said substantially cylindrical outer surface.

6. A developing roller according to claim 2, wherein each said encompassing perimeter has an area, each said area has a radius, each said recess comprises a wall, and the average slope angle of said wall, relative to a plane perpendicular to said radius of said area, is more than 35°.

7. A developing roller according to claim 2, including a distance between said encompassing perimeters of two adjacent said isolated areas, wherein said distance is more than or equal to 100 μm.

8. A developing roller according to claim 2, wherein said encompassing perimeters of said isolated areas have a circular, an oval, an irregular or a polygonal shape.

9. A developing roller according to claim 1, wherein said isolated areas are distributed over said substantially cylindrical outer surface according to a regular pattern.

10. A developing roller according to claim 1, wherein said recesses are obtained by tension-free processing of said substantially cylindrical outer surface.

11. A development unit for an electrostatic printer or copier apparatus for printing or copying markings on a medium, said development unit comprising:

a developing roller providing a magnetic brush, said developing roller comprising:

a non-magnetic steel sleeve with a substantially cylindrical outer surface having processed areas with material removed and unprocessed areas without material removed, at least part of said processed areas with material removed of said substantially cylindrical outer surface including a regular or irregular array of a number of neighbouring isolated areas, each said isolated area having a recess in said substantially cylindrical outer surface, each said recess completely surrounded on all sides and isolated from neighbouring isolated areas by separation zones, wherein said separation zones form part of said unprocessed areas without material removed of said substantially cylindrical outer surface such that said separation zones provide a substantially consistent surface topology at the substantially cylindrical outer surface of said developing roller, wherein both the surface of processed areas with material removed and the surface of unprocessed areas without material removed is non-magnetic steel.

12. An electrostatic printer or copier apparatus for printing or copying markings on a medium, said printer or copier apparatus comprising:

a developing roller providing a magnetic brush, said developing roller comprising:

a non-magnetic steel sleeve with a substantially cylindrical outer surface having processed areas with material removed and unprocessed areas without material removed, at least part of said processed areas with material removed of said substantially cylindrical outer surface including a regular or irregular array of a number of neighbouring isolated areas, each said isolated area having a recess in said substantially cylindrical outer surface, each said recess completely surrounded on all sides and isolated from neighbouring isolated areas by separation zones, wherein said separation zones form part of said unprocessed areas without material removed of said substantially cylindrical outer surface such that said separation zones provide a substantially consistent surface topology at the substantially cylindrical outer surface of said developing roller, wherein both the surface of processed areas with material removed and the surface of unprocessed areas without material removed is non-magnetic steel.

13. An electrostatic printer or copier apparatus for printing or copying markings on a medium, said printer or copier apparatus comprising a development unit, said development unit comprising:

a developing roller providing a magnetic brush, said developing roller comprising:

a non-magnetic steel sleeve with a substantially cylindrical outer surface having processed areas with material removed and unprocessed areas without material removed, at least part of said processed areas with material removed of said substantially cylindrical outer surface including a regular or irregular array of a number of neighbouring isolated areas, each said isolated area having a recess in said substantially cylindrical outer surface, each said recess completely surrounded on all sides and isolated from neighbouring isolated areas by separation zones, wherein said separation zones form part of said unprocessed areas without material removed of said substantially cylindrical outer surface such that said separation zones provide a substantially consistent surface topology at the substantially cylindrical outer surface of said developing roller, wherein both the surface of processed areas with material removed and the surface of unprocessed areas without material removed is non-magnetic steel.

14. A method of printing or copying markings on a medium using an electrostatic printer or copier, said method comprising the steps of:

providing a developing roller for providing a magnetic brush, wherein said developing roller comprises:

a non-magnetic steel sleeve with a substantially cylindrical outer surface having processed areas with material removed and unprocessed areas without material removed, at least part of said processed areas with material removed of said substantially cylindrical outer surface including a regular or irregular array of a number of neighbouring isolated areas, each said isolated area having a recess in said substantially cylindrical outer surface, each said recess completely surrounded on all sides and isolated from neighbouring isolated areas by separation zones, wherein said separation zones form part of said unprocessed areas without material removed of said substantially cylindrical outer surface such that said separation zones provide a substantially consistent surface topology at the substantially cylindrical outer surface of said developing roller, generating a magnetic brush by providing developer to said developing roller, using said magnetic brush to develop a latent image on a latent image bearing member, and forming an image on the surface of said medium using said latent image, wherein both the surface of processed areas with material removed and the surface of unprocessed areas without material removed is non-magnetic steel.

15. A method according to claim 14, wherein said developer comprises carrier particles having an average diameter; each said isolated area on said substantially cylindrical outer surface of said developing roller has a perimeter lying on said substantially cylindrical outer surface; and each said perimeter is such as to be equivalent to the perimeter of a circle having a diameter in the range of 5 to 20 times the average diameter of said carrier particles.

16. A method according to claim 15, wherein each said recess has a deepest point, and each said deepest point has a depth which is greater than said average diameter of said carrier particles.

17. A method according to claim 14, wherein said developer comprises toner particles, said toner particles having an FPIA roundness of more than 0.95.

18. A method according to claim 17, wherein said developing roller transfers said toner particles from said magnetic brush to said latent image bearing member at a transition point, wherein at said transition point, said developing roller has a linear speed of Vr, said latent image bearing member has a linear speed of Vf, in the same direction as said linear speed of said developing roller, and the ratio of Vr:Vf is less than 1.6.

19. A developing roller for providing a magnetic brush for an electrostatic printer or copier, said developing roller comprising:

a sleeve of a non-magnetic metal with a substantially cylindrical outer surface having processed areas with material removed and unprocessed areas without material being removed, at least part of said processed areas with material removed of said substantially cylindrical outer surface including a regular or irregular array of a number of neighbouring isolated areas, each said isolated area having a recess in said substantially cylindrical outer surface, each said recess completely surrounded on all sides and isolated from neighbouring isolated areas by separation zones, wherein said separation zones form part of said unprocessed areas without material removed of said substantially cylindrical outer surface such that said separation zones provide a substantially consistent surface topology at the substantially cylindrical outer surface of said developing roller, wherein both the surface of processed areas from which said non-magnetic metal has been removed and the surface of unprocessed areas from which none of said non-magnetic metal has been removed is of said non-magnetic metal.

20. The developing roller according to claim 19, wherein each said isolated area has an encompassing perimeter lying on said substantially cylindrical outer surface of said developing roller, and each said encompassing perimeter has a diameter in the range of 200 to 750 μm.

21. The developing roller according to claim 19, wherein each of said recesses provides a magnetic brush seat.

22. The developing roller according to claim 19, wherein said recesses are bucket shaped.

23. The developing roller according to claim 19, wherein each said recess has a deepest point having a depth of more than 30 μm from said substantially cylindrical outer surface.

24. The developing roller according to claim 20, wherein each said encompassing perimeter has an area, each said area has a radius, each said recess comprises a wall, and the average slope angle of said wall, relative to a plane perpendicular to said radius of said area, is more than 35°.

25. The developing roller according to claim 20, including a distance between said encompassing perimeters of two adjacent said isolated areas, wherein said distance is more than or equal to 100 μm.

26. The developing roller according to claim 20, wherein said encompassing perimeters of said isolated areas have a circular, an oval, an irregular or a polygonal shape.

27. The developing roller according to claim 19, wherein said isolated areas are distributed over said substantially cylindrical outer surface according to a regular pattern.

28. The developing roller according to claim 19, wherein said recesses are obtained by tension-free processing of said substantially cylindrical outer surface.

29. A developing roller for providing a magnetic brush for an electrostatic printer or copier, said developing roller comprising:

a sleeve of a durable material with a substantially cylindrical outer surface having processed areas with material removed and unprocessed areas without material being removed, at least part of said processed areas with material removed of said substantially cylindrical outer surface including a regular or irregular array of a number of neighbouring isolated areas, each said isolated area having a recess in said substantially cylindrical outer surface, each said recess completely surrounded on all sides and isolated from neighbouring isolated areas by separation zones, wherein said separation zones form part of said unprocessed areas without material removed of said substantially cylindrical outer surface such that said separation zones provide a substantially consistent surface topology at the substantially cylindrical outer surface of said developing roller, wherein both the surface of processed areas from which said durable material has been removed and the surface of unprocessed areas from which none of said durable material has been removed is of said durable material.

30. The developing roller according to claim 29, wherein each said isolated area has an encompassing perimeter lying on said substantially cylindrical outer surface of said developing roller, and each said encompassing perimeter has a diameter in the range of 200 to 750 μm.

31. The developing roller according to claim 29, wherein each of said recesses provides a magnetic brush seat.

32. The developing roller according to claim 29, wherein said recesses are bucket shaped.

33. The developing roller according to claim 29, wherein each said recess has a deepest point having a depth of more than 30 μm from said substantially cylindrical outer surface.

34. The developing roller according to claim 30, wherein each said encompassing perimeter has an area, each said area has a radius, each said recess comprises a wall, and the average slope angle of said wall, relative to a plane perpendicular to said radius of said area, is more than 35°.

35. The developing roller according to claim 30, including a distance between said encompassing perimeters of two adjacent said isolated areas, wherein said distance is more than or equal to 100 μm.

36. The developing roller according to claim 30, wherein said encompassing perimeters of said isolated areas have a circular, an oval, an irregular or a polygonal shape.

37. The developing roller according to claim 29, wherein said isolated areas are distributed over said substantially cylindrical outer surface according to a regular pattern.

38. The developing roller according to claim 29, wherein said recesses are obtained by tension-free processing of said substantially cylindrical outer surface.

* * * * *